US010702114B2

(12) United States Patent
Seasholtz et al.

(10) Patent No.: US 10,702,114 B2
(45) Date of Patent: Jul. 7, 2020

(54) VACUUM CLEANER HANDLE MOUNT ASSEMBLY

(71) Applicant: SHOP VAC CORPORATION, Williamsport, PA (US)

(72) Inventors: Craig A. Seasholtz, Avis, PA (US); Jason Gottschall, South Williamsport, PA (US); John Griffin, Phoenix, AZ (US)

(73) Assignee: SHOP VAC CORPORATION, Williamsport, PA (US)

( * ) Notice: Subject to any disclaimer, the term of this patent is extended or adjusted under 35 U.S.C. 154(b) by 29 days.

(21) Appl. No.: 15/703,140

(22) Filed: Sep. 13, 2017

(65) Prior Publication Data

US 2018/0078108 A1 Mar. 22, 2018

Related U.S. Application Data

(60) Provisional application No. 62/398,209, filed on Sep. 22, 2016.

(51) Int. Cl.
*A47L 9/32* (2006.01)
*A47L 5/36* (2006.01)

(52) U.S. Cl.
CPC ..... *A47L 9/325* (2013.01); *A47L 5/365* (2013.01); *A47L 9/327* (2013.01)

(58) Field of Classification Search
CPC . A47L 9/32; A47L 9/325; A47L 9/327; A47L 5/365; A47L 11/4075;
(Continued)

(56) References Cited

U.S. PATENT DOCUMENTS 1,720,948 A 7/1929 Duggan
2,724,598 A 11/1955 Knarzer
(Continued)

FOREIGN PATENT DOCUMENTS

DE 102012108651 A1 3/2014
EP 1922973 A2 5/2008
EP 2409629 A2 * 1/2012 ..... A47L 9/0009

OTHER PUBLICATIONS

Translation of EP 2409629, Retrived from Espacenet May 23, 2019 (Year: 2012).*
(Continued)

*Primary Examiner* — Laura C Guidotti
*Assistant Examiner* — Thomas Raymond Rodgers
(74) *Attorney, Agent, or Firm* — Marshall, Gerstein & Borun LLP

(57) ABSTRACT

A vacuum cleaner handle mount assembly securable to a vacuum cleaner having a handle that can be pivoted from a storage position to an in-use position is disclosed. The vacuum cleaner handle mount assembly has a housing with a first and second channel, a handle with a first and second leg for respectively connecting to the first and second channel of the housing, a first and second locking mechanism for preventing the handle from pivoting during use, and a first and second nest respectively disposed in a side of the first and second channel for holding the first and second locking mechanisms respectively. The first and second locking mechanisms are rotatable from an in-use position extending across the respective first and second channels above the respective first and second legs and a storage position wherein the first and second locking mechanisms are located within the first and second nest respectively.

24 Claims, 12 Drawing Sheets

(58) Field of Classification Search

CPC ..... B62B 21/523; B62B 5/061; B62B 5/062; B62B 5/067; B65D 25/2835; A45C 2013/265; A45C 2013/262; A45C 2013/26

USPC .... 15/410; 16/408–411, 426, 429, 436, 437, 16/438, 444, 445, 446

See application file for complete search history.

(56) References Cited

U.S. PATENT DOCUMENTS

| | | | | | |
|---|---|---|---|---|---|
| 2,959,342 | A | | 11/1960 | Silverstein | |
| 3,243,196 | A | | 3/1966 | Amis | |
| 3,509,590 | A | * | 5/1970 | Koshiyama | A47L 5/365 15/323 |
| 3,619,850 | A | * | 11/1971 | Rideout et al. | A47L 5/362 15/323 |
| 3,897,607 | A | * | 8/1975 | Schaffer | A47L 9/322 15/410 |
| 3,930,630 | A | * | 1/1976 | Wulff | A47L 9/325 248/129 |
| 4,110,869 | A | | 9/1978 | Hastings | |
| 4,115,890 | A | | 9/1978 | Burgoon | |
| 4,193,161 | A | * | 3/1980 | Scott | A47L 7/0038 15/352 |
| 4,245,371 | A | * | 1/1981 | Satterfield | A47L 7/008 15/320 |
| 4,592,482 | A | * | 6/1986 | Seager | A45C 11/20 220/318 |
| 4,632,888 | A | | 12/1986 | Kump et al. | |
| 4,705,282 | A | | 11/1987 | Berfield | |
| 5,269,157 | A | * | 12/1993 | Ciminelli | A45B 11/00 280/47.18 |
| 5,317,795 | A | | 6/1994 | Bolton et al. | |
| 5,507,071 | A | | 4/1996 | Berfield | |
| 5,901,408 | A | * | 5/1999 | Miller | A47L 11/4083 15/320 |
| D446,612 | S | * | 8/2001 | Kohler | D32/21 |
| 7,389,563 | B2 | * | 6/2008 | Martinez | A47L 7/0038 15/327.1 |
| 7,758,055 | B2 | | 7/2010 | Martinez | |
| 8,074,321 | B2 | * | 12/2011 | Fry | A47L 5/225 15/327.2 |
| 8,657,899 | B2 | * | 2/2014 | Joo | A47L 9/00 55/337 |
| 2003/0085552 | A1 | * | 5/2003 | Shapiro | B62B 1/206 280/646 |
| 2003/0229964 | A1 | * | 12/2003 | Thomason | A47L 5/28 15/353 |
| 2005/0091783 | A1 | * | 5/2005 | Sepke | A47L 9/0483 15/320 |
| 2005/0210626 | A1 | * | 9/2005 | Joung | A47L 9/325 15/410 |
| 2005/0257340 | A1 | * | 11/2005 | Parrott | A47L 5/365 15/353 |
| 2006/0137129 | A1 | * | 6/2006 | Schroter | A47L 9/26 15/323 |
| 2008/0115312 | A1 | * | 5/2008 | DiPasquale | A47L 5/365 15/327.2 |
| 2008/0115318 | A1 | * | 5/2008 | Phelan | A47L 5/365 15/410 |
| 2012/0180250 | A1 | * | 7/2012 | Ricklefsen | A47L 9/0009 15/300.1 |
| 2013/0031731 | A1 | * | 2/2013 | Hess | A47L 9/00 15/3 |
| 2013/0047353 | A1 | * | 2/2013 | Windmeisser | A47L 11/302 15/3 |
| 2013/0125337 | A1 | * | 5/2013 | Peflof | A47L 5/365 15/327.2 |
| 2015/0223652 | A1 | * | 8/2015 | Koura | A47L 5/365 15/327.2 |
| 2015/0351597 | A1 | * | 12/2015 | Wild | A47L 11/4041 15/320 |
| 2017/0086630 | A1 | * | 3/2017 | Fording | A47L 9/327 |

OTHER PUBLICATIONS

International Search Report issued in PCT/US2017/051256, dated Jan. 9, 2018.

Written Opinion issued in PCT/US2017/051256, dated Jan. 9, 2018.

International Preliminary Report on Patentability, corresponding international application No. PCT/US2017/051256, dated Apr. 4, 2019.

* cited by examiner

FIG. 5
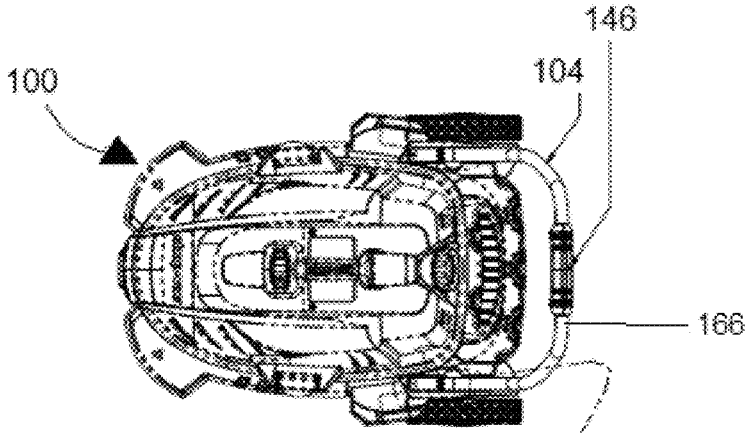
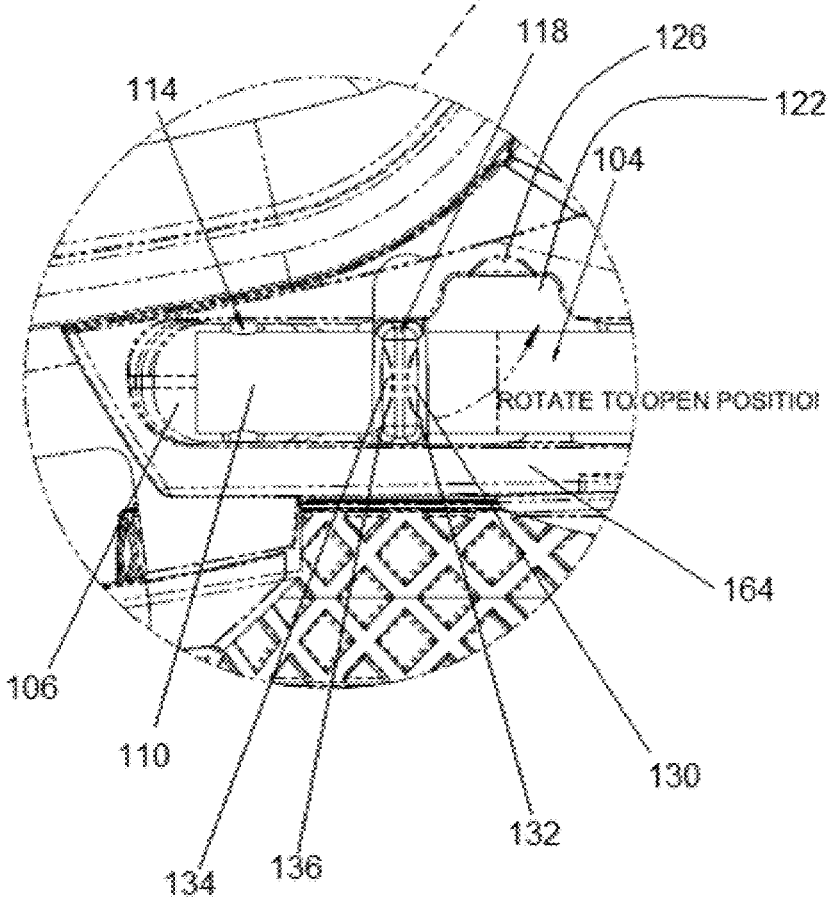
FIG. 5A

FIG. 6
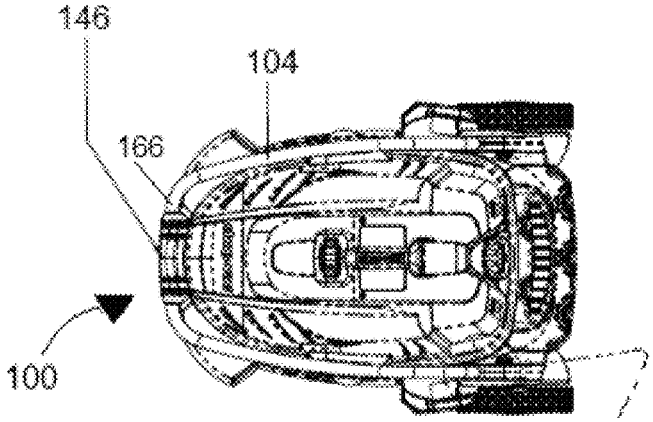
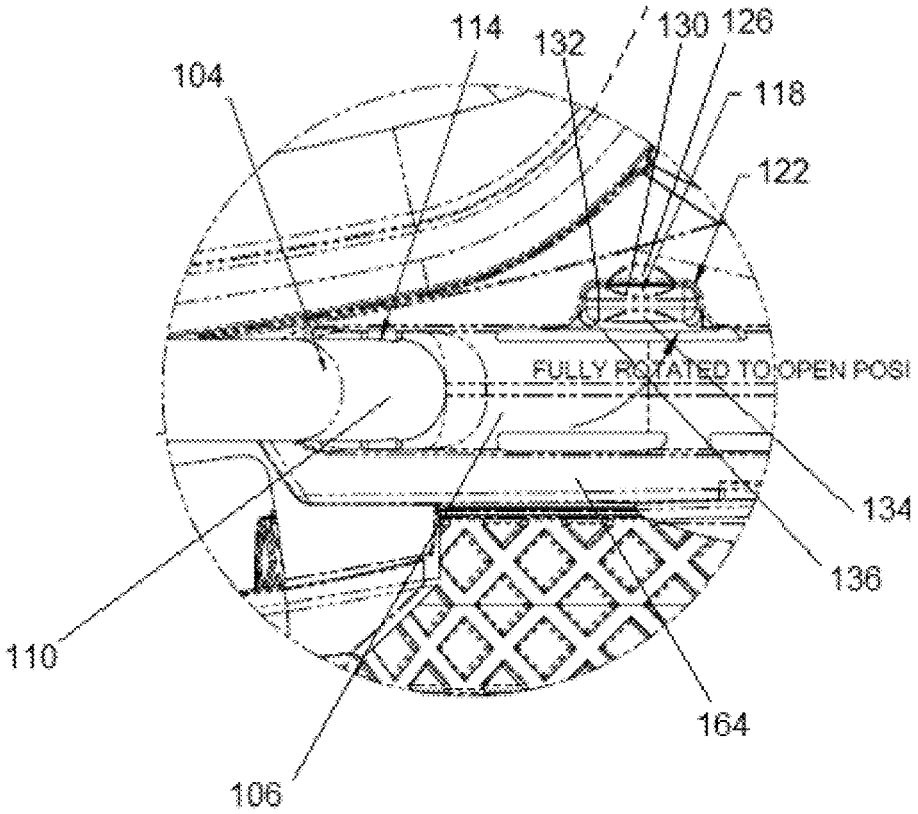
FIG. 6A

VACUUM CLEANER HANDLE MOUNT ASSEMBLY

CROSS-REFERENCE TO RELATED APPLICATION

The priority benefit of U.S. Provisional Patent Application No. 62/398,209, filed Sep. 22, 2016, and entitled "Vacuum Cleaner Handle Mount Assembly," is claimed and the entire contents thereof are incorporated by reference herein.

FIELD OF THE DISCLOSURE

This application relates generally to a vacuum cleaner handle mount assembly securable to a vacuum cleaner and, more specifically, to a vacuum cleaner mount assembly having a handle that can be pivoted from a storage position to an in-use position and secured in an in-use position by manually rotating a locking member.

BACKGROUND

When a vacuum cleaner is being used to vacuum, a handle on the vacuum cleaner is desirable in order for a user of the vacuum cleaner to easily direct movement of the vacuum cleaner. However, when the vacuum cleaner is not being used to vacuum, the vacuum cleaner is generally put into storage. The handle on a traditional vacuum cleaner is permanently fixed in position and juts outwardly from the rest of the vacuum cleaner. Accordingly, the handle on a traditional vacuum cleaner causes the vacuum cleaner to take up more space in storage than would be the case if the vacuum cleaner had no handle. A handle for a vacuum cleaner that can move between an in-use position to facilitate movement of the vacuum cleaner during vacuuming and a storage position to minimize the space taken up by the vacuum cleaner when the vacuum cleaner is not in use is therefore desirable. A movable handle is preferably lockable in the in-use position when a user is vacuuming in order to prevent the movable handle from transitioning to the storage position when a user is using the vacuum cleaner to vacuum.

SUMMARY

According to some aspects of the disclosure, a vacuum cleaner handle mount assembly has a mount housing with a first and second channel, a handle with a first and second leg for respectively pivotably securing to the first and second channel of the mount housing, a first locking mechanism for preventing the handle from pivoting during use, and a first nest disposed in a side of the first channel for holding the first locking mechanism, wherein the first locking mechanism is rotatable between an in-use position and a storage position, wherein the first locking mechanism extends across the first channel above the first leg in the in-use position and wherein the first locking mechanism is located within the first nest in the storage position. Arrangements may include a second locking mechanism for preventing the handle from pivoting during use and a second nest disposed in a side of the second channel for holding the second locking mechanism, wherein the second locking mechanism is rotatable between an in-use position and a storage position, wherein the second locking mechanism extends across the second channel above the second leg in the in-use position to prevent the handle from pivoting during use and wherein the second locking mechanism is located within the second nest in the storage position for permitting the handle to pivot for storage of the vacuum cleaner.

Further, arrangements may include a first and second finger indent adjacent to the respective first and second nest for allowing easier access for causing manual rotation of the respective first and second locking mechanism. Arrangements may include a first concave portion in a first side of the first locking mechanism, a second concave portion in a second side of the first locking mechanism that is opposite the first side of the first locking mechanism, a third concave portion in a first side of the second locking mechanism, and a fourth concave portion in a second side of the second locking mechanism that is opposite the first side of the second locking mechanism for allowing easier access for causing manual rotation of the first and second locking mechanisms. Arrangements may include the handle comprising a metal tube shaped to form the first leg and the second leg. Arrangements may include a handle cover secured to a lateral portion of the handle that connects the first leg to the second leg to facilitate gripping of the handle during use of the vacuum cleaner. Arrangements may include the handle cover comprising two pieces secured to one another by a connection mechanism that extends through the handle for keeping the handle cover in place on the handle during use. Arrangements may include the handle cover being made from injection molded plastic for manufacturing of the handle cover. Arrangements may include the mount housing including securement holes for connecting the vacuum cleaner handle mount assembly to a vacuum cleaner. Arrangements may include a first dowel pin pivotably connecting the first leg to the first channel for making the handle pivotable relative to the mount housing, a second dowel pin pivotably connecting the second leg to the second channel for making the handle pivotable relative to the mount housing, wherein the first and second locking mechanisms are spaced apart a distance from the respective first and second dowel pins along the respective axes of the first and second channels for preventing the handle from pivoting during use. Arrangements may include the first locking mechanism comprising a channel locking friction fit extension having an upper wall that engages a down-hanging wall of the first channel when the first locking mechanism is in the in-use position. Arrangements may include a latch for connecting the vacuum cleaner handle mount assembly to a vacuum body housing.

According to some aspects of the disclosure, a vacuum cleaner has a vacuum body housing and a vacuum cleaner handle mount assembly securable to the vacuum body housing, and the vacuum cleaner handle mount assembly has a mount housing with a first and second channel, a handle with a first and second leg for respectively pivotably securing to the first and second channel of the mount housing, a first locking mechanism for preventing the handle from pivoting during use, and a first nest disposed in a side of the first channel for holding the first locking mechanism, wherein the first locking mechanism is rotatable between an in-use position and a storage position, wherein the first locking mechanism extends across the first channel above the first leg in the in-use position and wherein the first locking mechanism is located within the first nest in the storage position. Arrangements may include the vacuum body housing having an exterior side and an interior side. Arrangements may include a vacuum pump to draw air into the interior side of the vacuum body housing. Arrangements may include the vacuum cleaner handle mount assembly having a second locking mechanism for preventing the handle from pivoting during use and a second nest disposed in a side of the second channel for holding the second locking mechanism, wherein the second locking mechanism is rotatable between an in-use position and a storage position, wherein the second locking mechanism extends across the second channel above the second leg in the in-use position to prevent the handle from pivoting during use and wherein the second locking mechanism is located within the second nest in the storage position for permitting the handle to pivot for storage of the vacuum cleaner.

Arrangements may further include the handle being configured to surround the vacuum body housing when pivoted to a storage position for convenient storage. Arrangements may include the handle being configured to extend above the vacuum body housing when pivoted to an in-use position for convenient movement of the vacuum cleaner. Arrangements may include the vacuum cleaner handle mount assembly having a first and second finger indent adjacent to the respective first and second nest for allowing easier access for causing manual rotation of the respective first and second locking mechanism. Arrangements may include the vacuum cleaner handle mount assembly having a first concave portion in a first side of the first locking mechanism, a second concave portion in a second side of the first locking mechanism that is opposite the first side of the first locking mechanism, a third concave portion in a first side of the second locking mechanism, and a fourth concave portion in a second side of the second locking mechanism that is opposite the first side of the second locking mechanism for allowing easier access for causing manual rotation of the first and second locking mechanisms. Arrangements may include the vacuum cleaner handle mount assembly having a handle cover secured to a lateral portion of the handle that connects the first leg to the second leg to facilitate gripping of the handle during use of the vacuum cleaner. Arrangements may include the handle cover comprising two pieces secured to one another by a connection mechanism that extends through the handle for keeping the handle cover in place on the handle during use. Arrangements may include the handle cover being made from an injection molded plastic for manufacturing of the handle cover. Arrangements may include the handle comprising a metal tube shaped to form the first leg and the second leg. Arrangements may include the first locking mechanism comprising a channel locking friction fit extension having an upper wall that engages a down-hanging wall of the first channel when the first locking mechanism is in the in-use position. Arrangements may include a latch for connecting the vacuum cleaner handle mount assembly to the vacuum body housing.

While the specification concludes with claims particularly pointing out and distinctly claiming the subject matter that is regarded as the present disclosure, it is believed that the disclosure will be more fully understood from the following description taken in conjunction with the accompanying drawings. Some of the figures may have been simplified by the omission of selected mechanisms for the purpose of more clearly showing other mechanisms. Such omissions of mechanisms in some figures are not necessarily indicative of the presence or absence of particular mechanisms in any of the exemplary arrangements, except as may be explicitly delineated in the corresponding written description. None of the drawings are necessarily to scale.

BRIEF DESCRIPTION OF THE DRAWINGS

FIG. 5 is top view of the vacuum cleaner according to the present disclosure with the vacuum cleaner handle mount assembly in an in-use position.

FIG. 5A is an enlarged view taken from FIG. 5 of a first locking mechanism of the vacuum cleaner handle mount assembly in an in-use position.

FIG. 6 is a top view of the vacuum cleaner according to the present disclosure with the vacuum cleaner handle mount assembly in a storage position.

FIG. 6A is an enlarged view taken from FIG. 6 of the first locking mechanism of the vacuum cleaner handle mount assembly in a storage position.

DETAILED DESCRIPTION OF THE DRAWINGS

Figure 1:
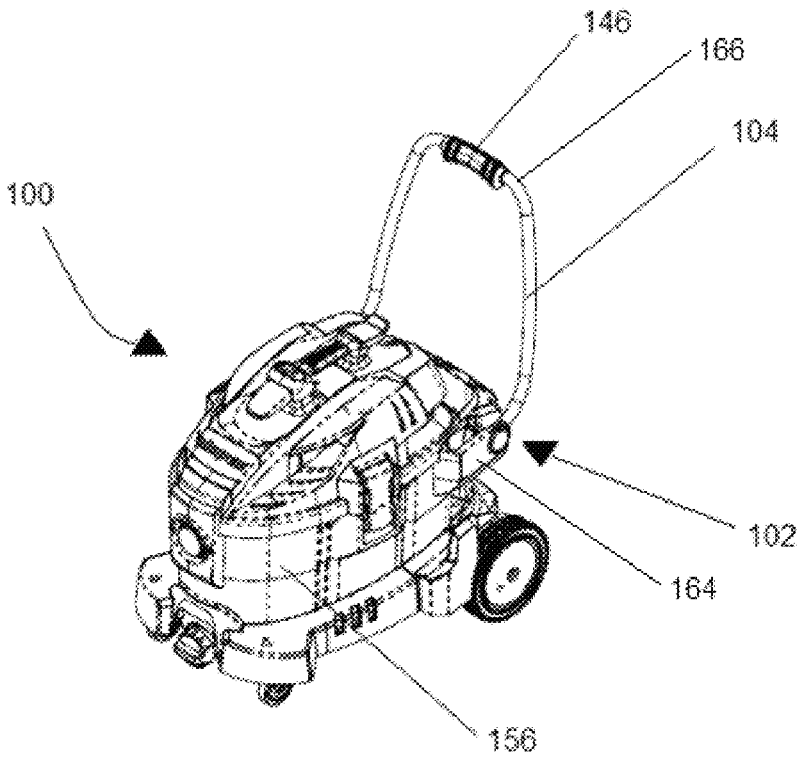
FIG. 1 is a front isometric view of a vacuum cleaner having a vacuum cleaner handle mount assembly in an in-use position.
Figure 2:
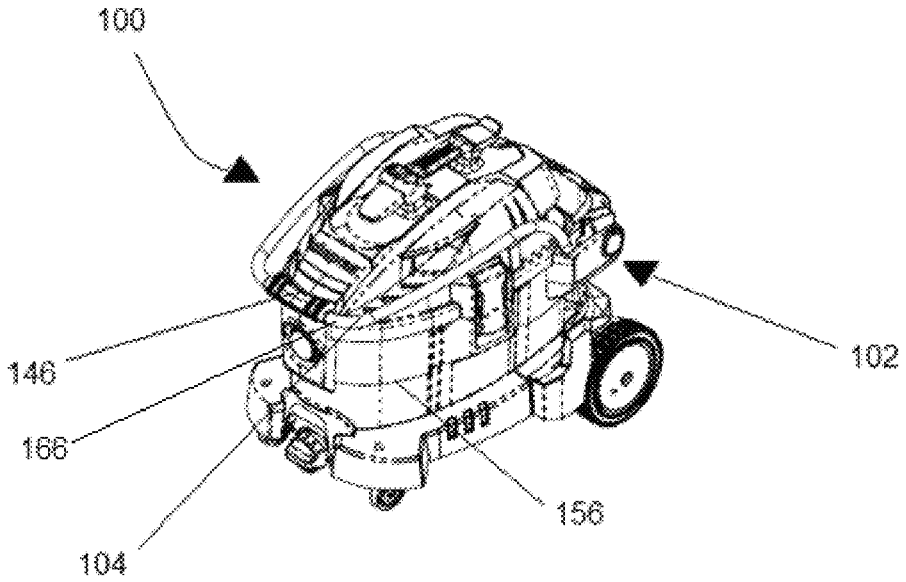
FIG. 2 is a front isometric view of the vacuum cleaner according to the present disclosure with the vacuum cleaner handle mount assembly in a storage position.
Figure 3:
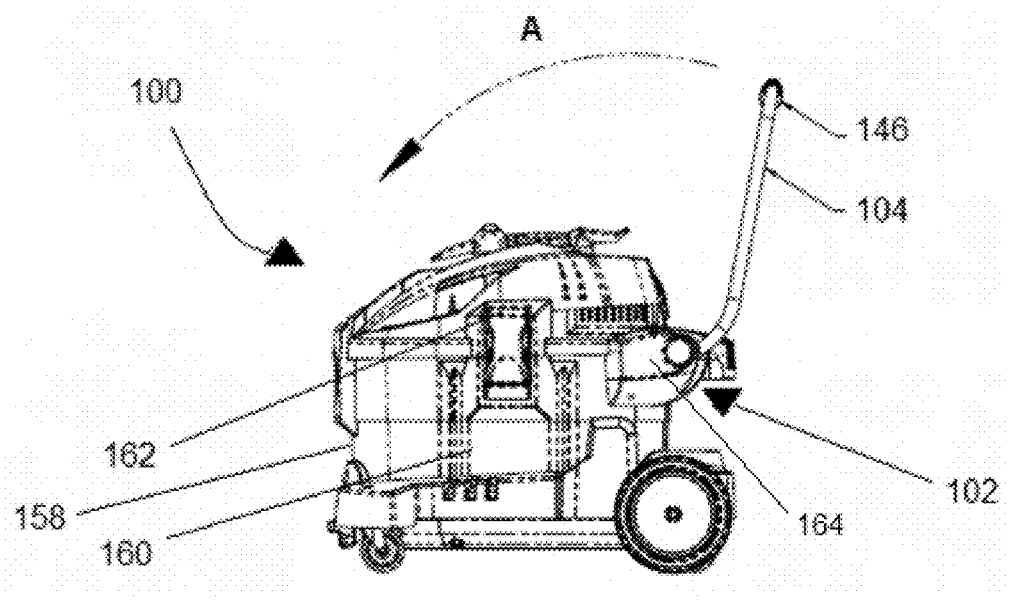
FIG. 3 is a side view of the vacuum cleaner according to the present disclosure with the vacuum cleaner handle mount assembly in an in-use position.
Figure 4:
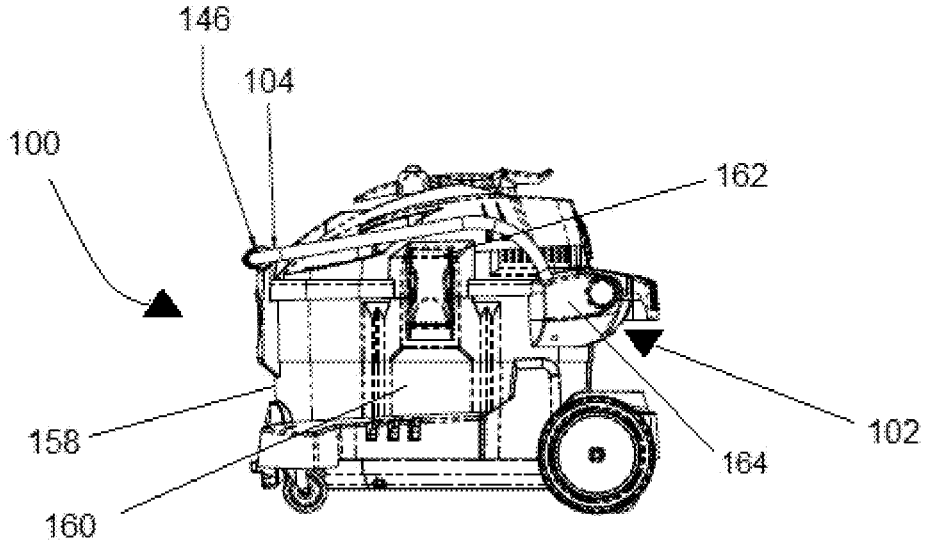
FIG. 4 is a side view of the vacuum cleaner according to the present disclosure with the vacuum cleaner handle mount assembly in a storage position.

Referring now to the exemplary arrangement shown in the drawings, FIGS. 1 and 3 show a vacuum cleaner 100 having a vacuum body housing 156 attached to a vacuum cleaner handle mount assembly 102 in an in-use position that allows convenient pushing and pulling of the vacuum cleaner 100 by a user. In the in-use position, a handle 104 of the vacuum cleaner mount assembly 102 extends above the vacuum body housing 156. The handle 104 includes a first leg 110 and a second leg 112 connected by a lateral portion 166. The first leg 110 and the second leg 112 each have a bent portion by which they are connected to a mount housing 164 and a long extension portion by which they extend over the vacuum body housing 156 to facilitate easy movement of the vacuum cleaner 100 by a standing user. A lateral portion 166 connects the long extension portion of the first leg 110 and the second leg 112. The handle may be formed from a metal tube and may include a housing cover 146 for comfortable gripping by a user. The housing cover 146 may be an injection molded plastic part. The vacuum body housing 156 has an exterior side 158 and an interior side 160. A vacuum pump 162 draws air into the interior side 160 of the vacuum body housing 156 for purposes of cleaning. FIG. 3 includes an arrow A indicating the direction the handle 104 may pivot to transition to a storage position. As seen in FIGS. 2 and 4, after pivoting to a storage position, the handle 104 is configured to surround the vacuum body housing 156. The storage configuration is more compact than the in-use position and thus allows the vacuum cleaner 100 to occupy less space.

FIGS. 5A and 6A show a first locking mechanism 118 that may secure the handle 104 in the in-use position or allow the handle 104 to pivot to the storage position. Preferably, a second locking mechanism 120 (shown in FIGS. 7 and 8) containing the same features and providing the same functionality is also provided on vacuum cleaner mount assembly 102, although only one of the locking mechanisms 118 or 120 could be used. A first channel 106 is disposed on an outer surface of the mount housing 164. A second channel 108 is disposed parallel to the first channel 106 on the outer surface of the mount housing 164 for connecting the mount housing to the handle 104. The first leg 110 of the handle 104 and the second leg 112 of the handle 104 are simultaneously securable in the first channel 106 and the second channel 108. A first dowel pin 114 secures the first leg 110 to the first channel 106, and a second dowel pin (not pictured) likewise secures the second leg 112 to the second channel 108. A first nest 122 is disposed in a side of the first channel 106 for holding the first locking mechanism 118 when the vacuum cleaner 100 is in storage position. A second nest 124 is disposed in a side of the second channel 108 for holding the second locking mechanism 120. The first locking mechanism 118 is rotatable from an in-use position, in which the first locking mechanism 118 extends across the first channel above the first leg to prevent the handle 104 from pivoting during use and a storage position wherein the first locking mechanism 118 is located within the first nest 122, thereby permitting the handle 104 to pivot for storage of the vacuum cleaner 100. The second locking mechanism 120 is similarly rotatable from an in-use position in which the second locking mechanism 120 extends across the second channel 108 above the second leg 112 to prevent the handle 104 from pivoting during use and a storage position wherein the second locking mechanism 120 is located within the second nest 124 to permit the handle 104 to pivot for storage of the vacuum cleaner 100.

As shown in FIGS. 5A and 6A, in order to prevent pivoting of the handle 104 during use, the first locking mechanism 118 is spaced apart a distance from the first dowel pin 114 along the axis of the first channel 106. Likewise, as partially shown in FIGS. 7 and 8, the second locking mechanism 120 is spaced apart a distance from the second dowel pin (not pictured) along the axis of the second channel 108 for preventing the handle from pivoting during use. Thus, the first dowel pin 114 and second dowel pin (not pictured) pivotably secure the bent portion of the first leg 110 and the second leg 112 respectively within the respective first channel 106 and second channel 108, and the first locking mechanism 118 and the second locking mechanism 120 respectively block the first leg 110 and second leg 112 from pivoting out of the first channel 106 and the second channel 108 when the first locking mechanism 118 and the second locking mechanism 120 are in their in-use positions.

The vacuum cleaner handle mount assembly 102 and the first locking mechanism 118 and second locking mechanism 120 may have grooves, indents, or the like on or near the nests 122 and 124 or on or near the locking mechanisms 118 or 120 to facilitate manipulation by a user's fingers. In FIGS. 5-9, a first finger indent 126 is provided adjacent to the first nest 122 and a second finger indent 128 is provided adjacent to the second nest 124. A first concave portion 130 is provided in a first side 132 of the first locking mechanism 118 and a second concave portion 134 is provided in a second side 136 of the first locking mechanism 118 that is opposite the first side 132. A third concave portion 138 is provided in a first side 140 of the second locking mechanism 120 and a fourth concave portion 142 is provided in a second side 144 of the second locking mechanism 120 that is opposite the first side 140 of the second locking mechanism 120.

Figure 9:
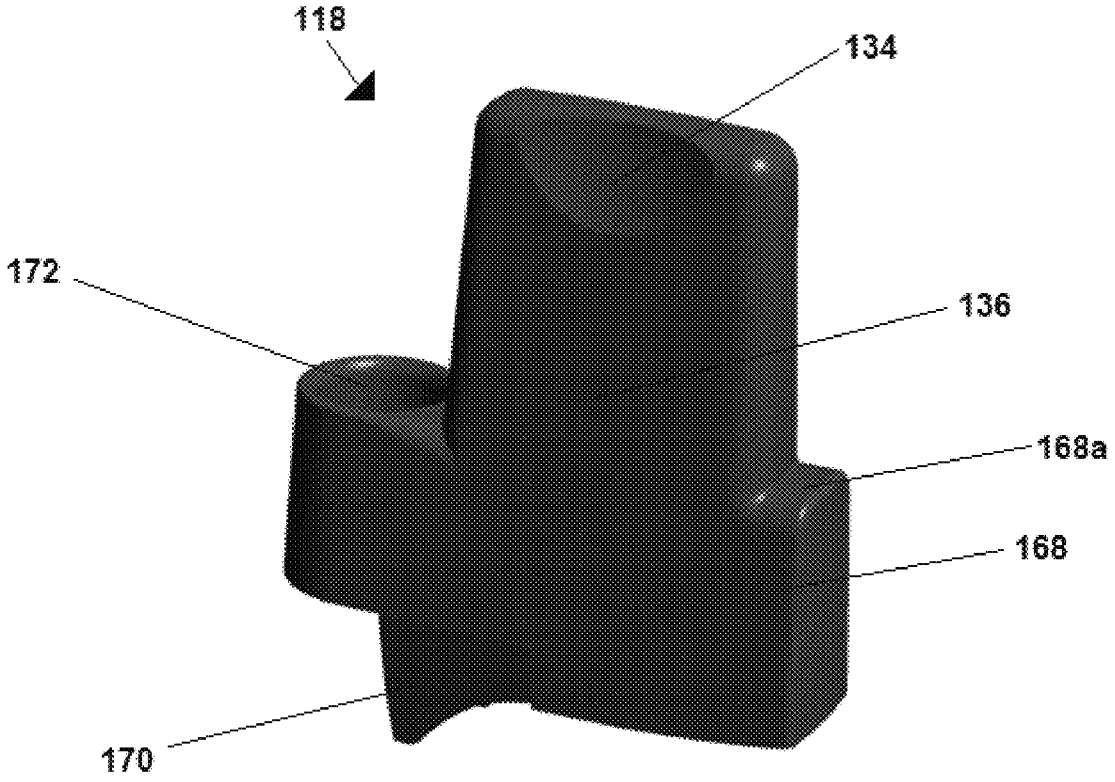
FIG. 9 is an isometric view of the first locking mechanism according to the present disclosure.
Figure 10:
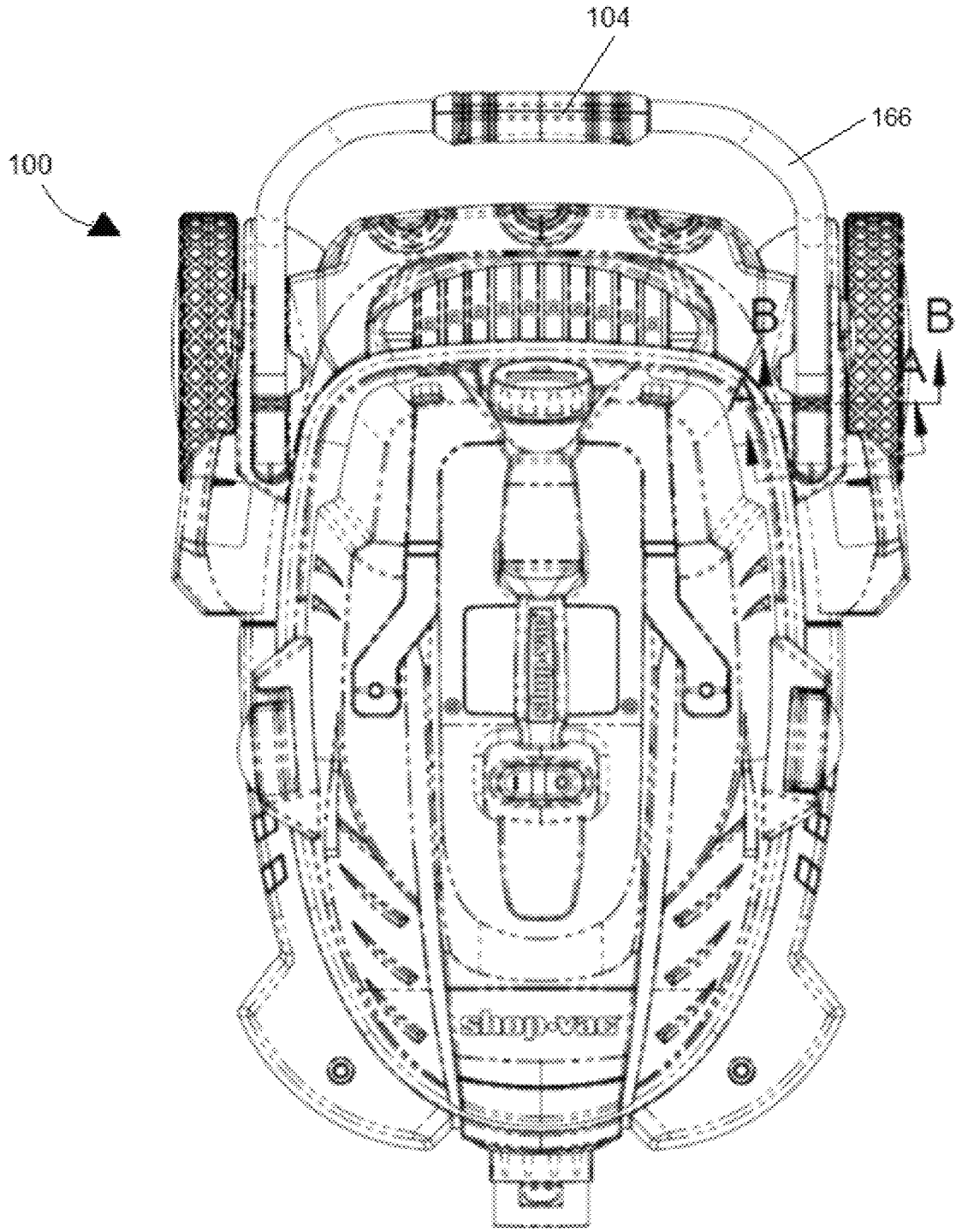
FIG. 10 is a top view of the vacuum cleaner according to the present disclosure with the vacuum cleaner handle mount assembly in an in-use position.
Figure 10A:
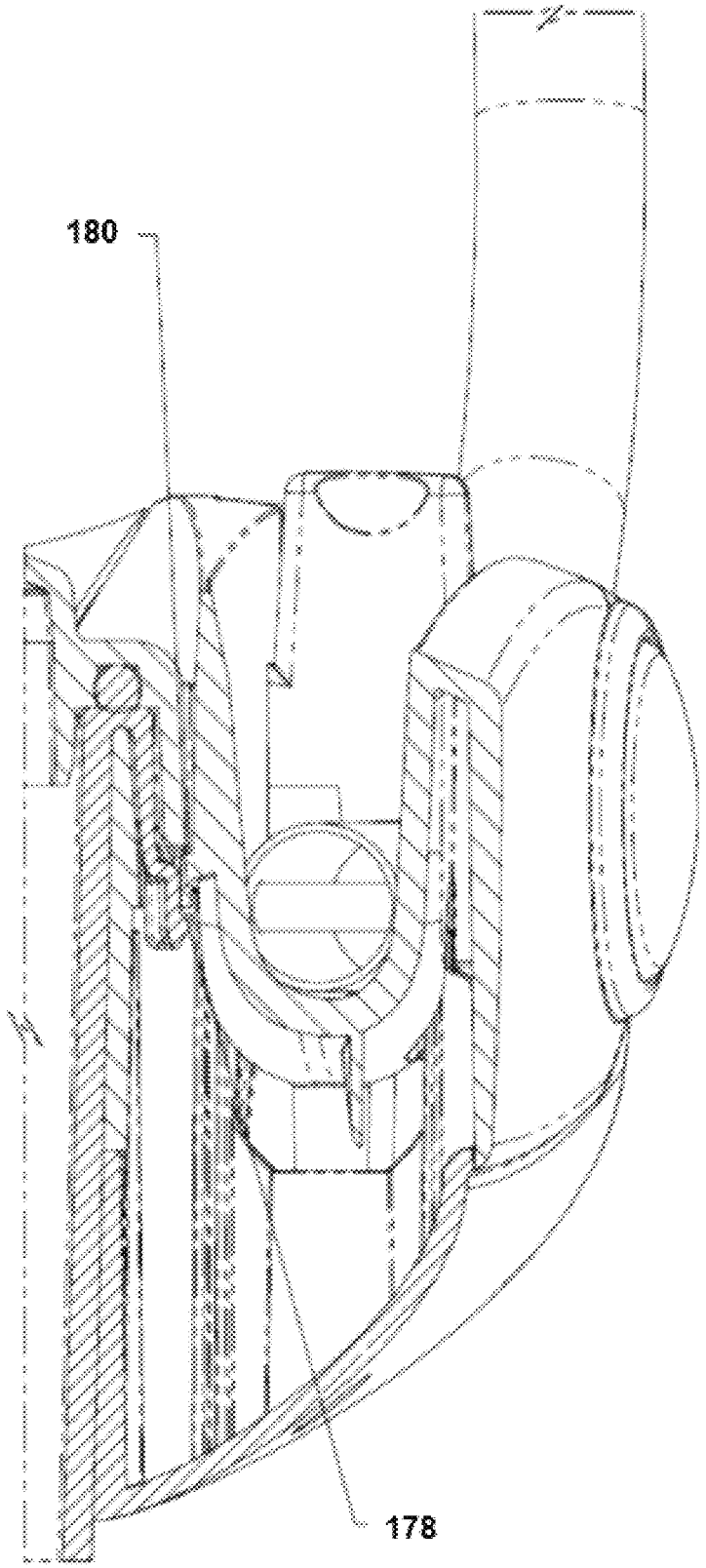
FIG. 10A is a cross-sectional view of the vacuum cleaner according to the present disclosure taken along line A-A to show a latch for securing the vacuum cleaner handle mount assembly to the vacuum body housing.
Figure 10B:
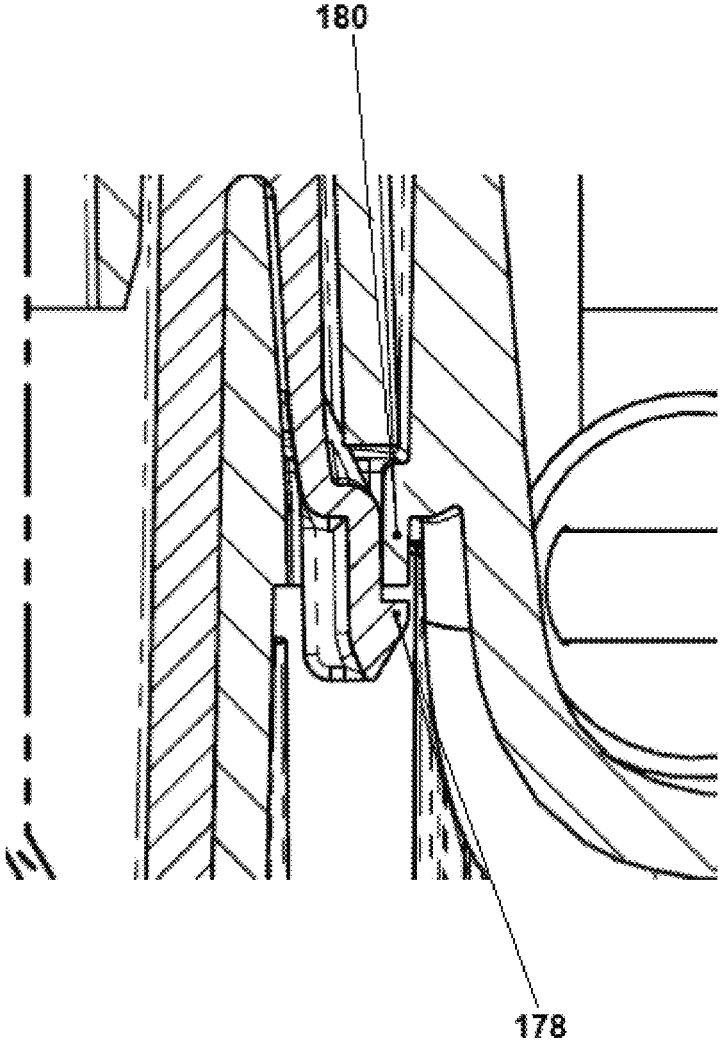
FIG. 10B is an enlarged view taken from FIG. 10A of the latch for securing the vacuum cleaner handle mount assembly to the vacuum body housing.
Figure 10C:
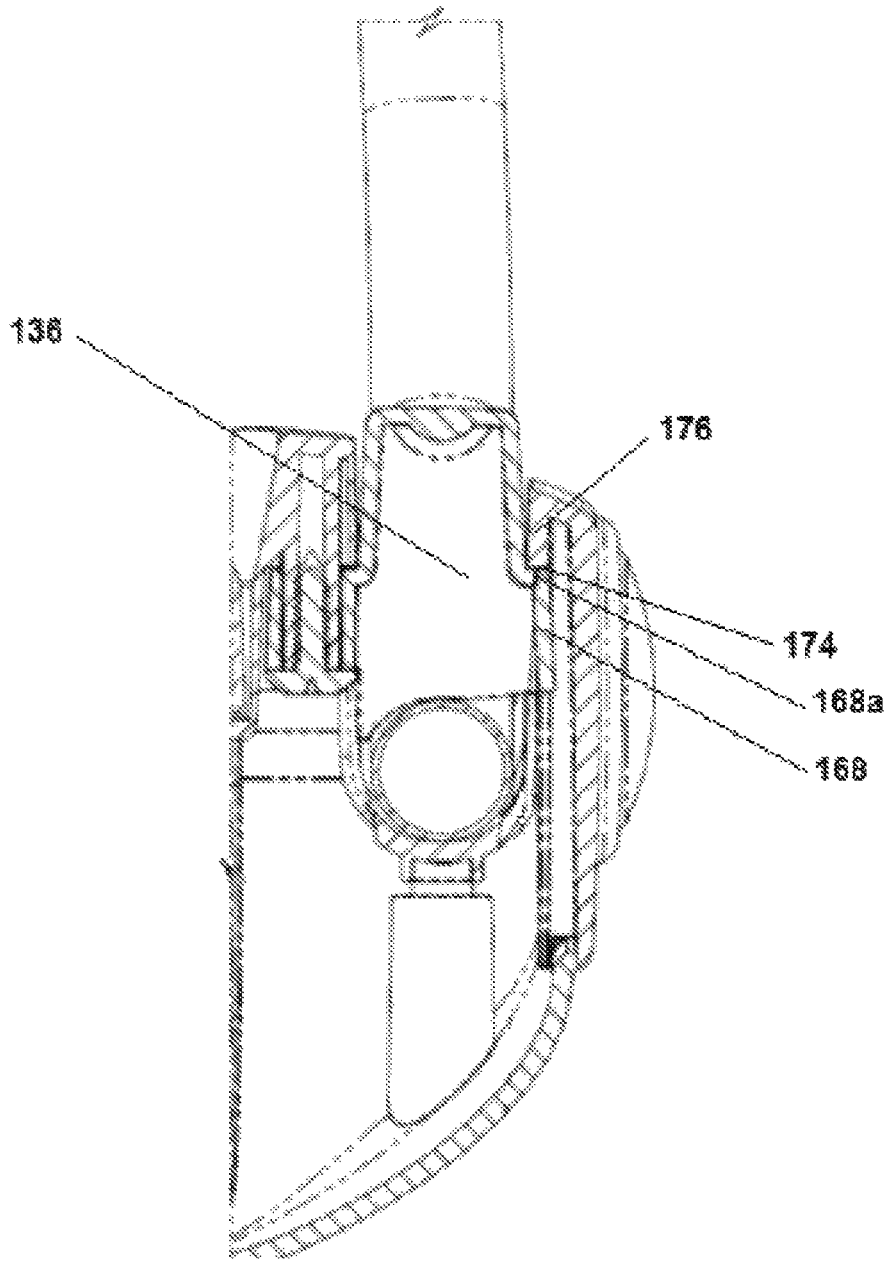
FIG. 10C is a cross-sectional view of the vacuum cleaner according to the present disclosure taken along line B-B to show the channel friction fit extension of the first locking mechanism in the vacuum body housing.
Figure 10D:
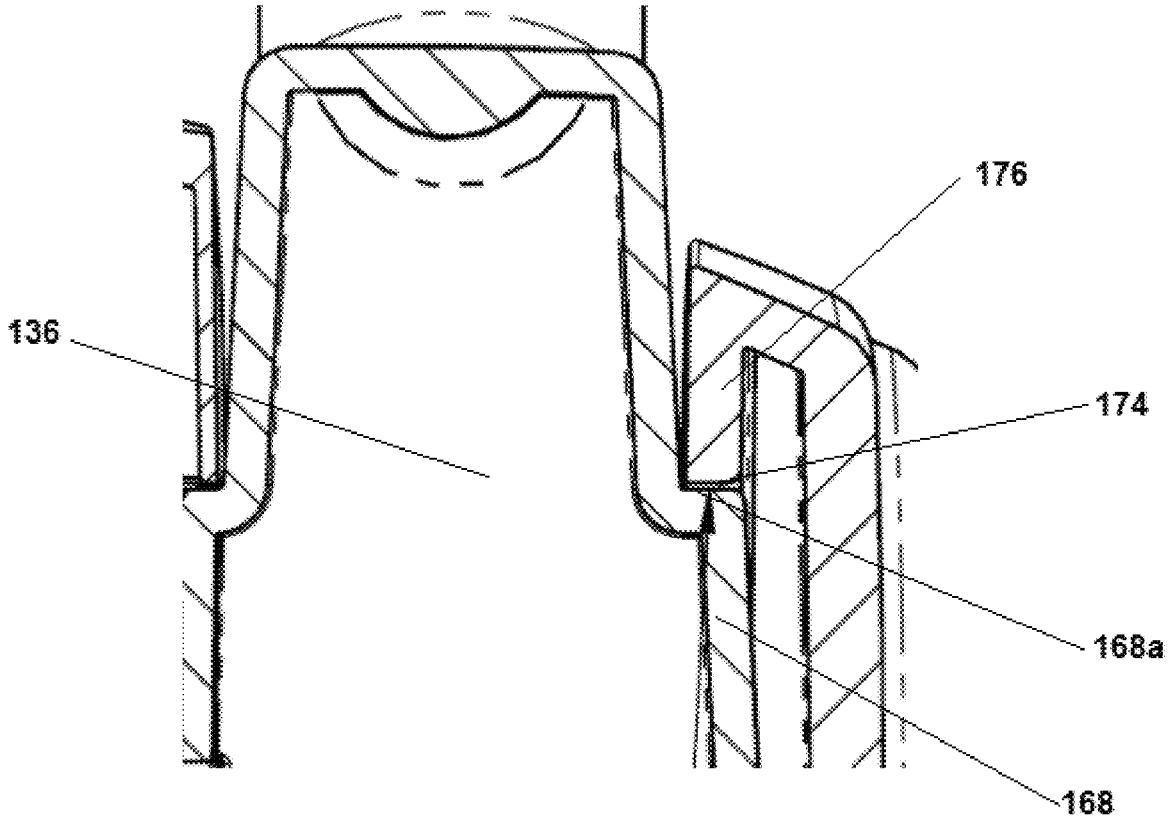
FIG. 10D is an enlarged view taken from FIG. 10C of the channel friction fit extension in the vacuum body housing.

As shown in FIG. 9, the first locking mechanism 118 may include a connection aperture 172 for pivotably securing the first locking mechanism 118 in the first channel 106. A leg friction fit component 170 may have a curved shape that is complementary to the first leg 110 and that engages the first leg 110 when the first locking mechanism 118 is in the in-use position. The first locking mechanism 118 may further include a channel friction fit extension 168 having an upper wall 168*a* that engages a down-hanging wall 176 of the first channel 106 when the first locking mechanism 118 is in the in-use position as shown in FIGS. 10C and 10D. The second locking mechanism may likewise contain these features.

Figure 7:
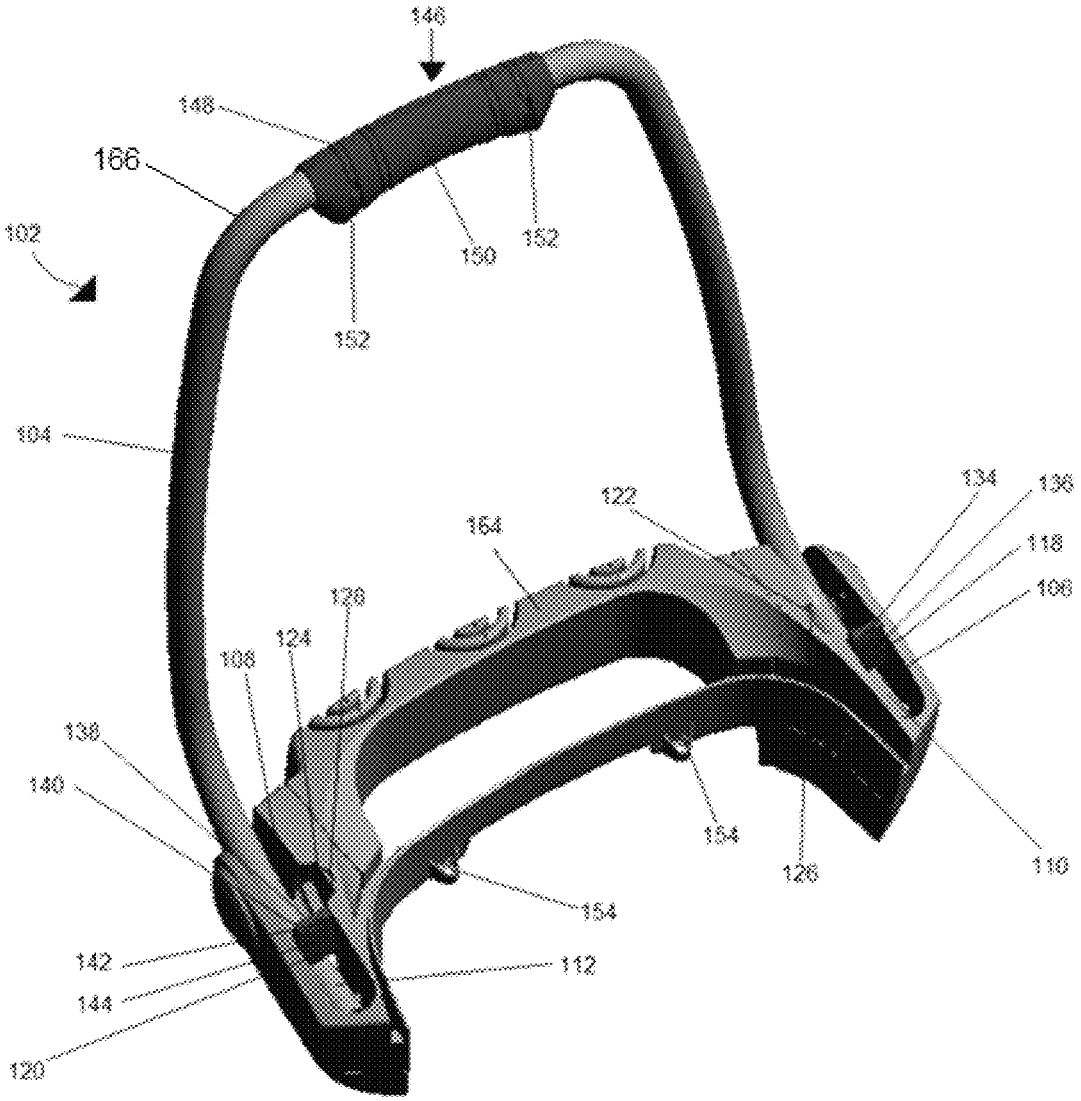
FIG. 7 is an isometric view of the vacuum cleaner handle mount assembly according to the present disclosure, wherein the vacuum cleaner handle mount assembly is separate from the vacuum body housing and in the in-use position.

As shown in FIG. 7, the handle cover 146 has a first piece 148 secured to a second piece 150 by a connection mechanism, such as a screw or a friction fit pin, that extends through the handle 104 for keeping the handle cover 146 in place on the handle 104 during use. The first piece 148 and second piece 150 may have ridges or other friction generating patterns on their surface in order to keep a user's hand from slipping when gripping the handle cover 146. When secured on the handle 104, the handle cover 146 may have a curved shape in which the ends of the handle cover 146 project further from the handle 104 than the central portion of the handle cover 146. This curved shape may be useful to keep a user's hand from slipping off the handle cover 146 and on to the handle 104.

Figure 8:
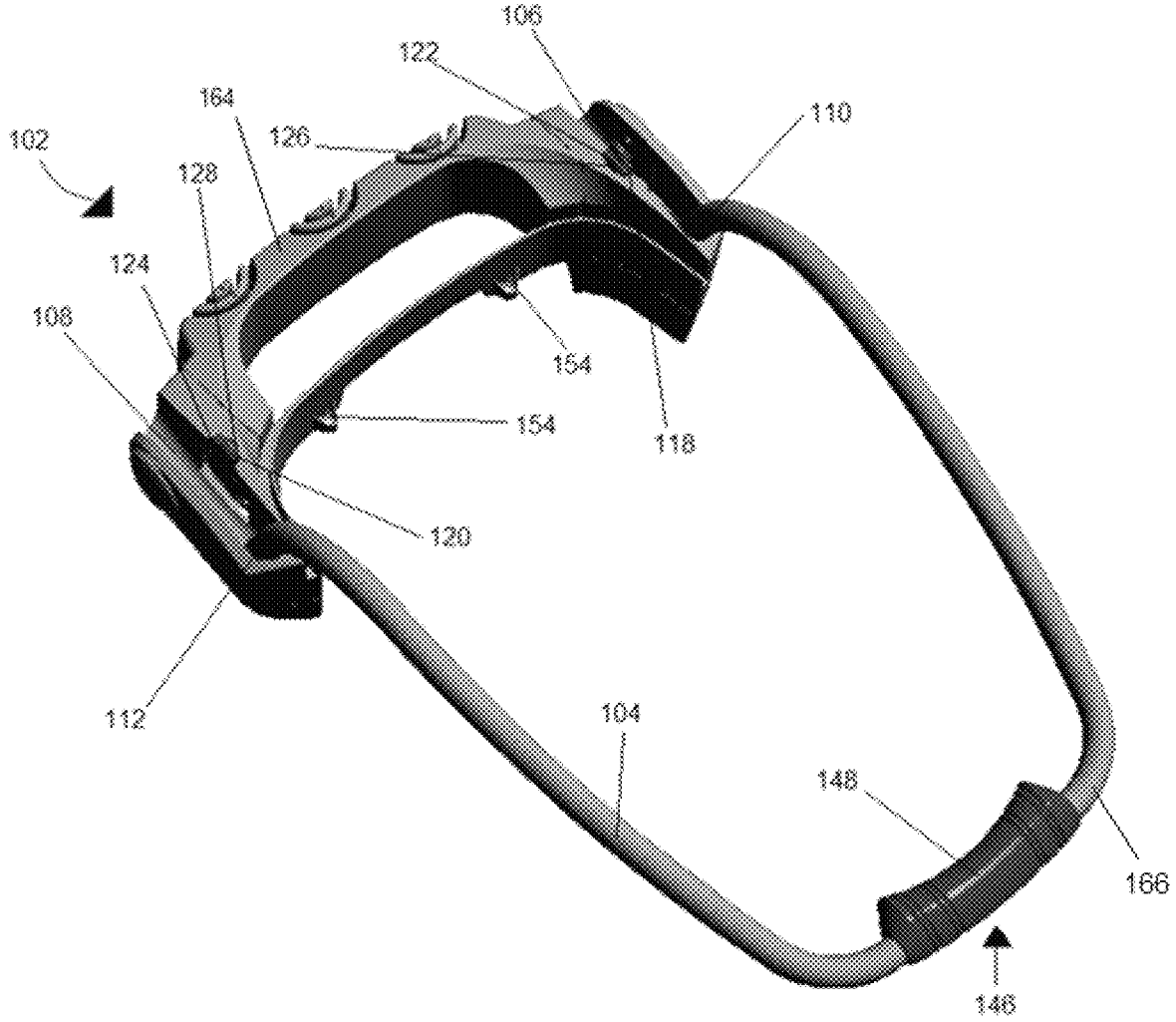
FIG. 8 is an isometric view of the vacuum cleaner handle mount assembly according to the present disclosure, wherein the vacuum cleaner handle mount assembly is separate from the vacuum body housing and in the storage position.

As shown in FIGS. 7 and 8, the mount housing 164 has securement holes 154 for connecting the vacuum cleaner handle mount assembly 102 to the vacuum cleaner 100. Additionally, the vacuum cleaner handle mount assembly 102 has a latch 178 that snaps around a vertical wall 180 of the vacuum body housing 156, as shown in FIGS. 10A and 10B. A second latch (not pictured) is provided on the opposite side of the vacuum cleaner 100 to connect with a second vertical wall (not pictured) on the vacuum body housing 156.

While particular arrangements of the present invention have been illustrated and described, it would be appreciated to those skilled in the art that various other changes and modifications can be made without departing from the spirit of the invention. It is therefore intended to cover in the appended claims all such changes and modifications.

What is claimed is:

1. A vacuum cleaner handle mount assembly comprising:

a handle for pushing a vacuum cleaner, the handle having a first leg and a second leg;

a mount housing for connecting the handle to the vacuum cleaner and on which the handle is disposed, the handle pivotable relative to the mount housing, and the mount housing having a first channel for connecting the mount housing to the handle, the first channel having two walls extending vertically from the mount housing and facing each other to form a first area in the mount housing, and a second channel disposed parallel to the first channel for connecting the mount housing to the handle, the second channel having two walls extending vertically from the mount housing and facing each other to form a second area in the mount housing, wherein the first leg is pivotably secured in the first area by a first dowel pin connecting the first leg between the two walls of the first channel for making the handle pivotable relative to the mount housing and the second leg is pivotably secured in the second area by a second dowel pin connecting the second leg between the two walls of the second channel for making the handle pivotable relative to the mount housing;

a first pivoting lock for preventing the handle from pivoting during use; and a first nest disposed in one of the two walls of the first channel for holding the first pivoting lock;

wherein the first pivoting lock is rotatable between an in-use position and a storage position, wherein the first pivoting lock is spaced apart a distance from the first dowel pin along a longitudinal axis of the first channel for preventing the handle from pivoting during use and wherein the first pivoting lock is located within the first nest in the storage position for permitting the handle to pivot for storage of the vacuum cleaner, the first pivoting lock rotatable along an axis of rotation different from an axis of rotation of the first leg and an second axis of rotation of the second leg.

2. The vacuum cleaner handle mount assembly of claim 1, further comprising:

a second pivoting lock for preventing the handle from pivoting during use; and a second nest disposed in one of the two walls of the second channel for holding the second pivoting lock;

wherein the second pivoting lock is rotatable between an in-use position and a storage position, wherein the second pivoting lock extends across the second channel over the second leg in the in-use position to prevent the handle from pivoting during use and wherein the second pivoting lock is located within the second nest in the storage position for permitting the handle to pivot for storage of the vacuum cleaner.

3. The vacuum cleaner handle mount assembly of claim 2, further comprising:

a first finger indent adjacent to the first nest for allowing easier access for causing manual rotation of the first pivoting lock; and a second finger indent adjacent to the second nest for allowing easier access for causing manual rotation of the second pivoting lock.

4. The vacuum cleaner handle mount assembly of claim 2, further comprising:

a first concave portion in a first side of the first pivoting lock for allowing easier access for causing manual rotation of the first pivoting lock;

a second concave portion in a second side of the first pivoting lock that is opposite the first side of the first pivoting lock for allowing easier access for causing manual rotation of the first pivoting lock;

a third concave portion in a first side of the second pivoting lock for allowing easier access for causing manual rotation of the first pivoting lock; and a fourth concave portion in a second side of the second pivoting lock that is opposite the first side of the second pivoting lock for allowing easier access for causing manual rotation of the second pivoting lock.

5. The vacuum cleaner handle mount assembly of claim 1, wherein the handle comprises a metal tube shaped to form the first leg and the second leg.

6. The vacuum cleaner handle mount assembly of claim 1, further comprising a handle cover secured to a lateral portion of the handle that connects the first leg to the second leg to facilitate gripping of the handle during use of the vacuum cleaner.

7. The vacuum cleaner handle mount assembly of claim 6, wherein the handle cover comprises two pieces secured to one another by a connection mechanism that extends through the handle for keeping the handle cover in place on the handle during use.

8. The vacuum cleaner handle mount assembly of claim 6, wherein the handle cover is an injection molded plastic for manufacturing of the handle cover.

9. The vacuum cleaner handle mount assembly of claim 1, wherein the mount housing includes securement holes for connecting the vacuum cleaner handle mount assembly to the vacuum cleaner.

10. The vacuum cleaner handle mount assembly of claim 2, further comprising:

wherein the second pivoting lock is spaced apart a distance from the second dowel pin along axis of the second channel for preventing the handle from pivoting during use.

11. The vacuum cleaner handle mount assembly of claim 1, wherein the first pivoting lock comprises a channel locking friction fit extension having an upper wall that engages a down-hanging wall of the first channel when the first pivoting lock is in the in-use position.

12. The vacuum cleaner handle mount assembly of claim 1, further comprising a latch for connecting the vacuum cleaner handle mount assembly to a vacuum body housing.

13. A vacuum cleaner comprising:

a vacuum body housing having an exterior side;

a vacuum pump to draw air into the interior side of the vacuum body housing;

a vacuum cleaner handle mount assembly securable to the vacuum body housing comprising:

a handle having a first leg and a second leg;

a mount housing for connecting the handle to the vacuum cleaner and on which the handle is disposed, the handle pivotable relative to the mount housing, and the mount housing having a first channel for connecting the mount housing to the handle, the first channel having two walls extending vertically from the mount housing and facing each other to form a first area in the mount housing, and a second channel disposed parallel to the first channel for connecting the mount housing to the handle, the second channel having two walls extending vertically from the mount housing and facing each other to form a second area in the mount housing, wherein the first leg is pivotably secured in the first area by a dowel pin connecting the first leg between the two walls of the first channel for making the handle pivotable relative to the mount housing and the second leg is pivotably secured in the second area between the two walls of the second channel for making the handle pivotable relative to the mount housing;

a first pivoting lock for preventing the handle from pivoting during use; and a first nest disposed in one of the two walls of the first channel for holding the first pivoting lock;

wherein the first pivoting lock is rotatable between an in-use position and a storage position, wherein the first pivoting lock is spaced apart a distance from the dowel pin along a longitudinal axis of the first channel for preventing the handle from pivoting during use and wherein the first pivoting lock is located within the first nest in the storage position for permitting the handle to pivot for storage of the vacuum cleaner, the first pivoting lock rotatable along an axis of rotation different from an axis of rotation of the first leg and an second axis of rotation of the second leg.

14. The vacuum cleaner of claim 13, wherein the vacuum cleaner handle mount assembly further comprises:

a second pivoting lock for preventing the handle from pivoting during use; and a second nest disposed in one of the two walls of the second channel for holding the second pivoting lock;

wherein the second pivoting lock is rotatable between an in-use position and a storage position, wherein the second pivoting lock extends across the second channel over the second leg in the in-use position to prevent the handle from pivoting during use and wherein the second pivoting lock is located within the second nest in the storage position for permitting the handle to pivot for storage of the vacuum cleaner.

15. The vacuum cleaner of claim 13, wherein the handle is configured to surround the vacuum body housing when pivoted to a storage position for convenient storage.

16. The vacuum cleaner of claim 13, wherein the handle is configured to extend above the vacuum body housing when pivoted to an in-use position for convenient movement of the vacuum cleaner.

17. The vacuum cleaner of claim 14, wherein the vacuum cleaner handle mount assembly further comprises:

a first finger indent adjacent to the first nest for allowing easier access for causing manual rotation of the first pivoting lock; and a second finger indent adjacent to the second nest for allowing easier access for causing manual rotation of the second pivoting lock.

18. The vacuum cleaner of claim 14, wherein the vacuum cleaner handle mount assembly further comprises:

a first concave portion in a first side of the first pivoting lock for allowing easier access for causing manual rotation of the first pivoting lock;

a second concave portion in a second side of the first pivoting lock that is opposite the first side of the first pivoting lock for allowing easier access for causing manual rotation of the first pivoting lock;

a third concave portion in a first side of the second for allowing easier access for causing manual rotation of the first pivoting lock; and a fourth concave portion in a second side of the second pivoting lock that is opposite the first side of the second pivoting lock for allowing easier access for causing manual rotation of the second pivoting lock.

19. The vacuum cleaner of claim 13, wherein the vacuum cleaner handle mount assembly further comprises a handle cover secured to a lateral portion of the handle that connects the first leg to the second leg to facilitate gripping of the handle during use of the vacuum cleaner.

20. The vacuum cleaner of claim 19, wherein the handle cover comprises two pieces secured to one another by a connection mechanism that extends through the handle for keeping the handle cover in place on the handle during use.

21. The vacuum cleaner of claim 19, wherein the handle cover is an injection molded plastic for manufacturing the handle cover.

22. The vacuum cleaner of claim 13, wherein the handle comprises a metal tube shaped to form the first leg and the second leg.

23. The vacuum cleaner of claim 13, wherein the first pivoting lock comprises a channel locking friction fit extension having an upper wall that engages a down-hanging wall of the first channel when the first pivoting lock is in the in-use position.

24. The vacuum cleaner of claim 13, further comprising a latch for connecting the vacuum cleaner handle mount assembly to the vacuum body housing.

* * * * *